United States Patent [19]

Vassar

[11] Patent Number: 4,622,747

[45] Date of Patent: Nov. 18, 1986

[54] CUTTING DEVICE AND METHOD FOR PROFILING SHEET MATERIAL

[76] Inventor: Kendall J. Vassar, 620 51st Ave. NE., Columbia Heights, Minn. 55421

[21] Appl. No.: 773,051

[22] Filed: Sep. 6, 1985

[51] Int. Cl.[4] ..... B26B 5/00

[52] U.S. Cl. ..... 30/293; 33/27.02; 33/41.5; 33/42

[58] Field of Search ..... 30/289, 290, 293, 294; 33/42, 27.02, 148 R, 149 R, 150, 41 R, 41 E, 41 F; 83/56

[56] References Cited

U.S. PATENT DOCUMENTS

| | | | |
|---|---|---|---|
| 717,883 | 1/1903 | Mathews | 30/293 |
| 1,615,288 | 1/1927 | Maimin | 30/293 |
| 1,830,860 | 11/1931 | Scoles | 33/42 X |
| 2,007,396 | 7/1935 | Howard | 30/293 X |
| 3,191,295 | 6/1965 | Falk | 30/293 X |
| 3,504,435 | 4/1970 | Sloboda et al. | 30/293 |
| 3,644,994 | 2/1972 | Lind | 30/293 X |
| 3,934,343 | 1/1976 | Witecki | 33/27.02 X |

*Primary Examiner*—James F. Coan

*Attorney, Agent, or Firm*—Peterson, Wicks, Nemer & Kamrath

[57] ABSTRACT

The method includes the steps of placing one edge of a resilient sheet, such as vinyl, in adjacent relation with an irregular or nonlinear edge with which the material is to be mated or fitted. When so positioned, one leg of a device or tool is moved along the irregular edge, the device having a second leg that is clamped in an angular relationship with the first leg. The second leg carries a blade at the lower end thereof so that the blade cuts along a line having the same profile as the edge with which the material is to be mated. Such a procedure severs a relatively narrow strip from the sheet material so that the edge formed on the remaining sheet material corresponds in profile to the edge with which the sheet material is to be fitted. The remaining sheet material is then moved toward the edge to be fitted until the profiled edge meets or abuts the edge to be fitted. The legs of the device are angularly adjustable and one leg thereof includes two longitudinally adjustable components. A clamping mechanism is provided for holding the two components in a preferred longitudinally adjusted relationship, the clamping mechanism including a stirrup-like bolt provided with a flat that bears against a flat on a generally cylindrical shank forming an integral part of the second component. In this way, the blade is constrained to follow a path parallel to the two flats and also to follow a path determined by the movement of the first leg of the device along the edge to be fitted.

14 Claims, 9 Drawing Figures

CUTTING DEVICE AND METHOD FOR PROFILING SHEET MATERIAL

BACKGROUND OF THE INVENTION

1. Field of the Invention

This invention relates generally to a cutting tool and method for profiling sheet stock, and pertains more particularly to the laying of vinyl, carpeting and similar material where one edge of the material must conform or fit accurately to a nonlinear or irregular edge.

2. Description of the Prior Art

In the past, the profiling of linoleum was relatively easy in that the surface of such a material could be readily marked by indenting or embossing a line with a scriber. With the scribed mark or line remaining visible, it was a fairly easy chore to cut along the indented or embossed line with a linoleum knife.

However, with the advent of vinyl for use as a floor covering, the inherent resiliency of such a material has made it far more difficult to fit a sheet of vinyl to a nonlinear or irregular edge, for the indented or scribed mark quickly disappears or closes up. In other words, the linoleum, when scribed, provided a line or a mark having a "memory," whereas vinyl possesses virtually no such memory.

Consequently, it has been the practice to use felt paper as a pattern. The scribing is done on the felt paper and the scratched line remains in the surface of such paper. Thereafter, the worker follows along the scribed line of the felt paper with a set of dividers in order to scribe a corresponding line or mark onto the projecting marginal portion of the vinyl sheet that has been placed beneath the felt paper.

To some extent, the laying of carpeting has posed a similar problem, for carpeting cannot be really marked in that its soft surface has no capability as far as retaining a scribed line. Even chalk marking is usually limited to initial cutting of the stock, the use of chalk not being sufficiently accurate for fitting the carpeting to an irregular edge.

The problems of laying both vinyl and carpeting have been compounded by the relatively recent use of floor outlets for telephones and data processing equipment in modern day offices, since the flexible covering material, whether it be vinyl or carpeting, has to be accurately cut where the floor outlets are located. Even drains can present a fitting problem, especially since vinyl is usually used where drains are encountered. Quite obviously, the drains, to be useful, must be exposed, and the flexible floor covering material cut accordingly.

It has been difficult at times to fit wall coverings. In this regard, it is becoming more and more common to apply flexible carpeting and relatively heavy vinyl wallpaper to vertical walls. Sometimes the walls are not square, and frequently there must be cuts for light switches. Although not of a flexible character, the installation of sheet rock or wall board can cause trouble where it must be fitted to an irregular edge or surface.

Insofar as I am aware, no satisfactory cutting tool or method has been devised which will enable the worker to cut flexible materals of the above type, doing so directly even though the material is to be fitted or mated with an irregular or nonlinear edge.

SUMMARY OF THE INVENTION

Accordingly, an object of the present invention is to speed up the profiling of sheet material, especially where such material cannot be readily marked. In this regard, an aim of the invention is to permit the precise fitting of vinyl, carpeting and similar materials to an irregular or nonlinear edge.

Another object of my invention is to reduce the need for making patterns that have heretofore been required. More specifically, an aim of the invention is to cut or profile one edge directly, thereby obviating the need for making a pattern that would conform to the first irregular edge. The opportunity for the worker to select the most intricate nonlinear edge as the first edge enables him, in a number of instances, to fit the remaining edges of a room or other object in a freehanded manner.

Yet another object of the invention is to obtain a more precise fit of the sheet material even when using a pattern. In such situations, the worker can first make a pattern by scribing the felt paper with dividers, doing so along all four edges of the room, and then use my cutting device to cut the vinyl sheet, after placing it under the pattern with marginal portions of the sheet protruding in all four directions, by following the scribed line or mark that he has made in the felt paper pattern.

Still another object of my invention is to provide a cutting device and method that will be adjustable to the specific conditions encountered in a given situation. In this way, my invention permits a reduction in the amount of sheet material that is wasted. In some instances, the saving can avoid having to use another sheet in the covering of, say, the floor of a room.

Additionally, my invention has for another object the beveling of the irregular or nonlinear edge being cut, for my invention permits the cutting at a slanted or oblique angle, the profiled edge in this way sloping away from the irregular or nonlinear edge to be mated. Consequently, should there be required a refined trimming of the cut or profiled irregular edge, only the material adjacent the exposed surface need be trimmed.

Generally, it should be recognized that my invention enables the profiling of resilient floor coverings, wall coverings, vinyl-covered panels that should not be marked with a pencil, and even certain construction materials, doing so in a rapid and more accurate manner than formerly done.

Briefly, my invention envisages the placing of the sheet material to be profiled with one edge adjacent the edge to be mated. When so positioned, then a cutting device, made in accordance with the teachings of my invention, is used to cut one edge along an irregular or nonlinear line so that the severed strip can be easily removed. After removal of the severed strip, then the sheet of material can be abutted against the edge that the profiled edge is to engage. The cutting device is comprised of pivotally mounted legs, one of which legs has a relatively blunt tip formed thereon so that it can be moved along the irregular or nonuniform edge to be fitted, whether such edge be the edge of a room, the edge of a bathtub, the edge of some appliance or some other object in a room that has a surface edge to be covered. The other leg has a blade mounted thereon so that the knife edge of the blade follows a precise path corresponding to the irregular edge to be fitted with the particular sheet material. In this way, the cutting or profiling of the edge to be fitted is realized at the same time that the tool is being moved along the irregular edge to be fitted. The worker selects the most intricate edge and the tracing of the most intricate edge at least avoids the need for making a pattern corresponding to the first edge of a room or like that is to be fitted. If the other edges of a room are irregular, then a conventional pattern can be made. However, the avoidance of a pattern for the first edge produces substantial savings, both in the way of time and material. Inasmuch as an oblique or beveled edge is automatically achieved during the profiling or cutting operation, a relatively thin edge exists at the exposed surface which can be further trimmed if need be.

DESCRIPTION OF THE PREFERRED EMBODIMENT

Figure 2:
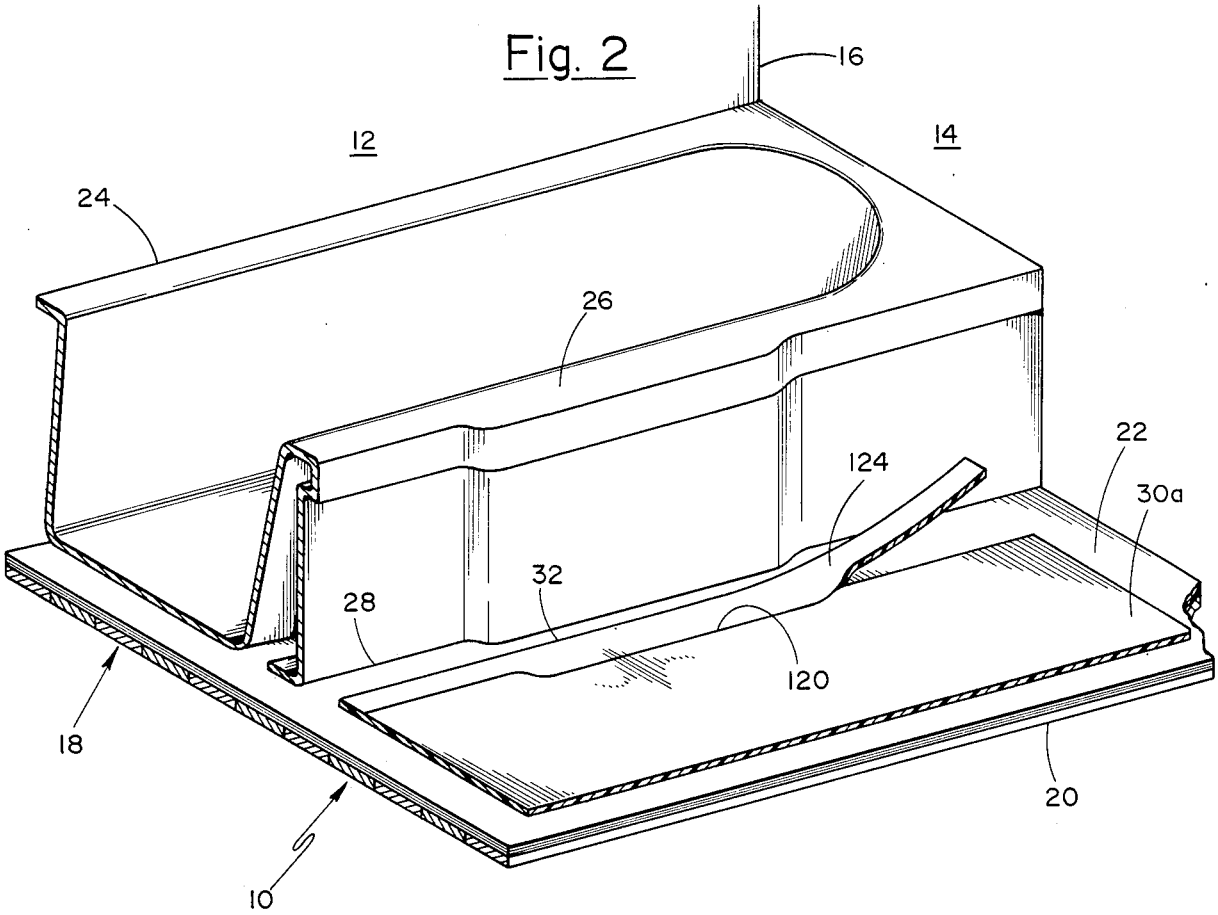
FIG. 2 is a view similar to FIG. 1 but illustrating more of the bathtub and also the removal of the severed strip resulting from the profiling step appearing in FIG. 1.
Figure 3:
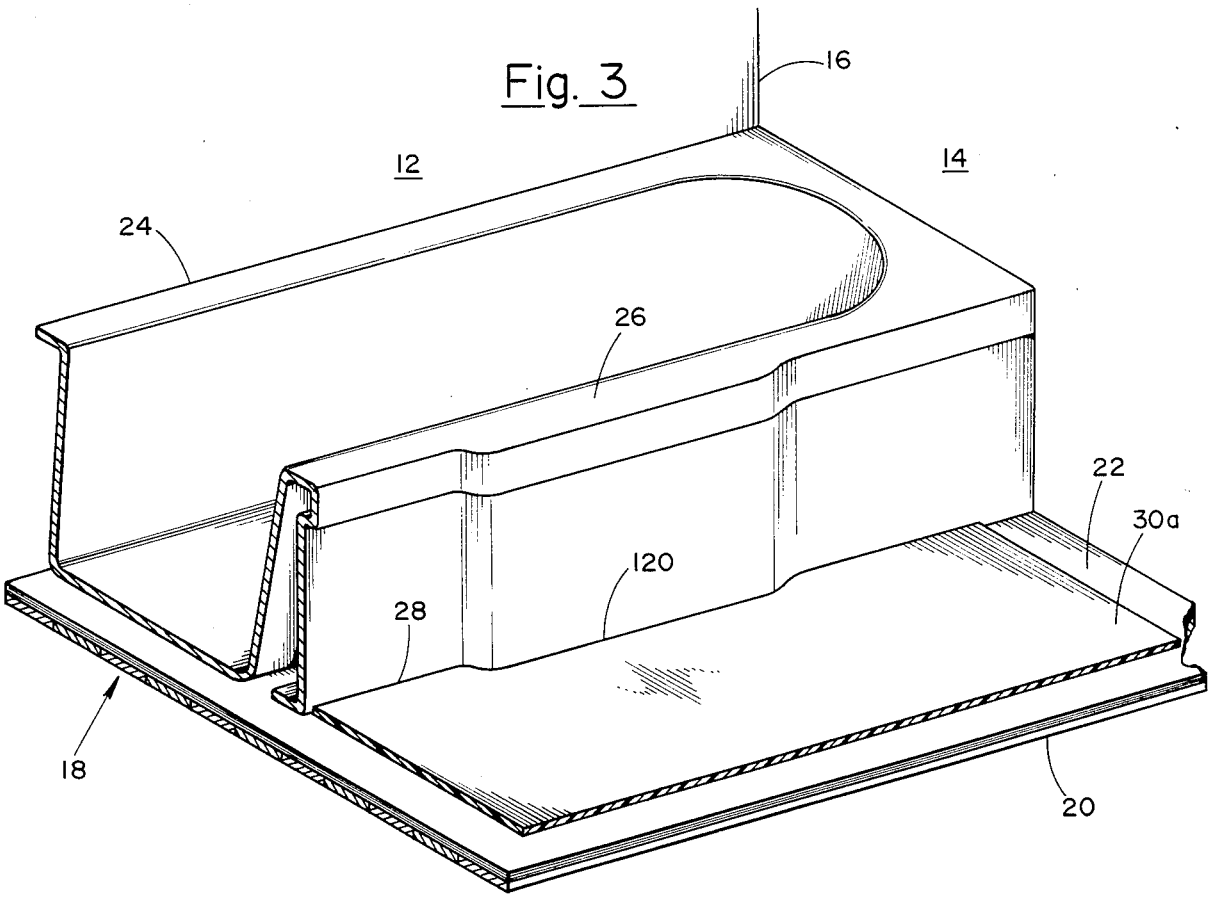
FIG. 3 is a view corresponding to FIG. 2 but with the profiled edge of the vinyl sheet moved into an abutting relationship with the bathtub.

In order to illustrate my invention, a portion of a bathroom 10 has been illustrated. In FIGS. 2 and 3, intersecting vertical walls 12 and 14 appear, the walls forming a corner edge 16. The bathroom 10 has a floor 18 comprised of a subfloor 20 and a plywood underlayment 22.

In the bathroom 10 is a fragmentarily pictured bathtub 24 having a seat portion 26, the seat portion 26 forming an irregular or nonlinear edge at 28. As the description progresses, it will be recognized that the irreglar nonlinear edge 28 can be far more intricate than that illustrated. However, the relatively simply edge 28 suffices to demonstrate the benefits to be derived from a practicing of my invention.

Figure 1:
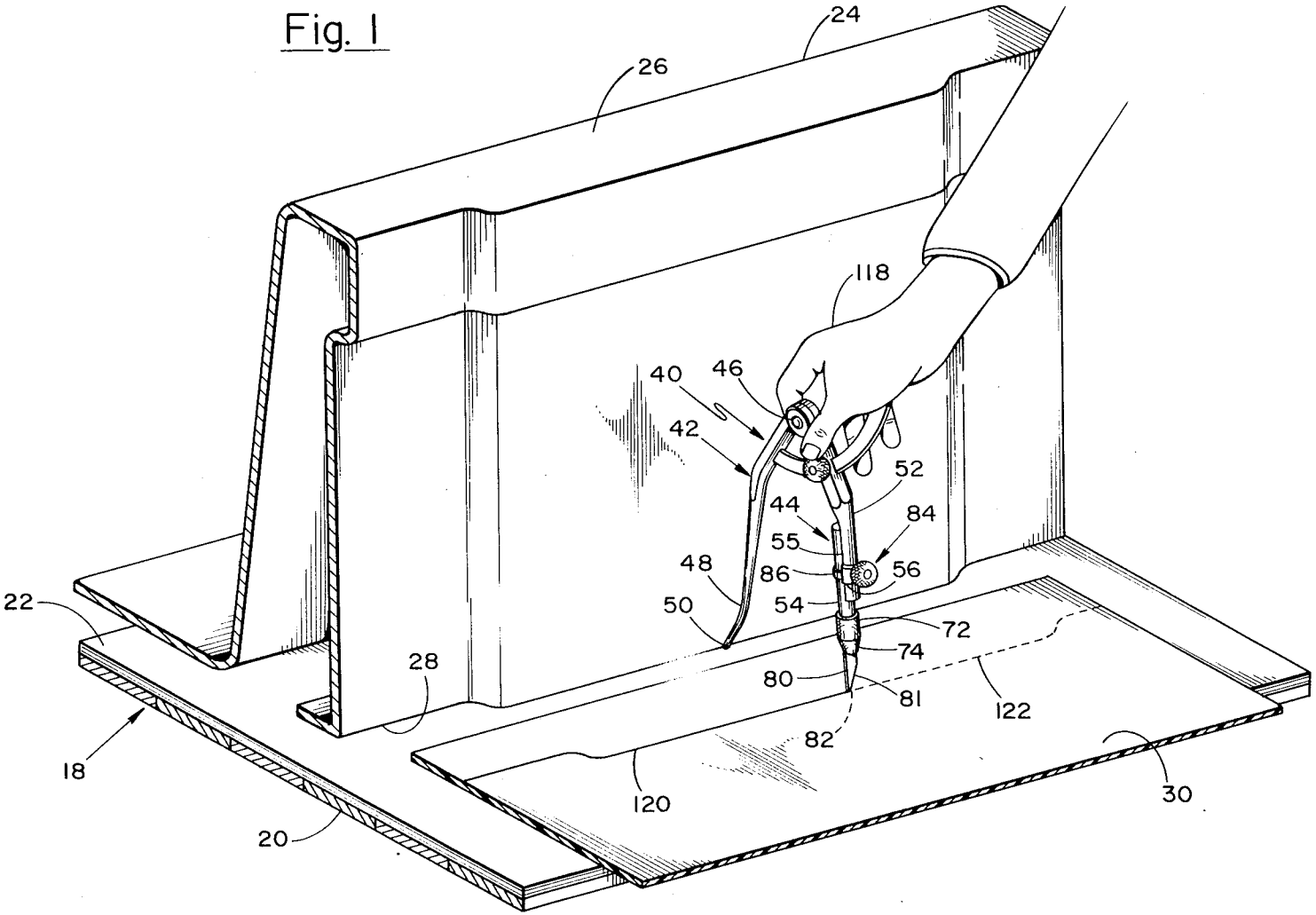
FIG. 1 is a perspective view showing my cutting device in actual use, the view illustrating the profiling of a fragmentarily depicted sheet of vinyl with respect to an irregular edge formed by a fragmentarily pictured bathtub.

A portion of a vinyl sheet 30 having a straight machine or factory edge 32 appears in FIGS. 1 and 2. It will be appreciated that the straight edge 32 must be profiled in order to conform to the irregular or nonlinear edge 28.

Figure 5:
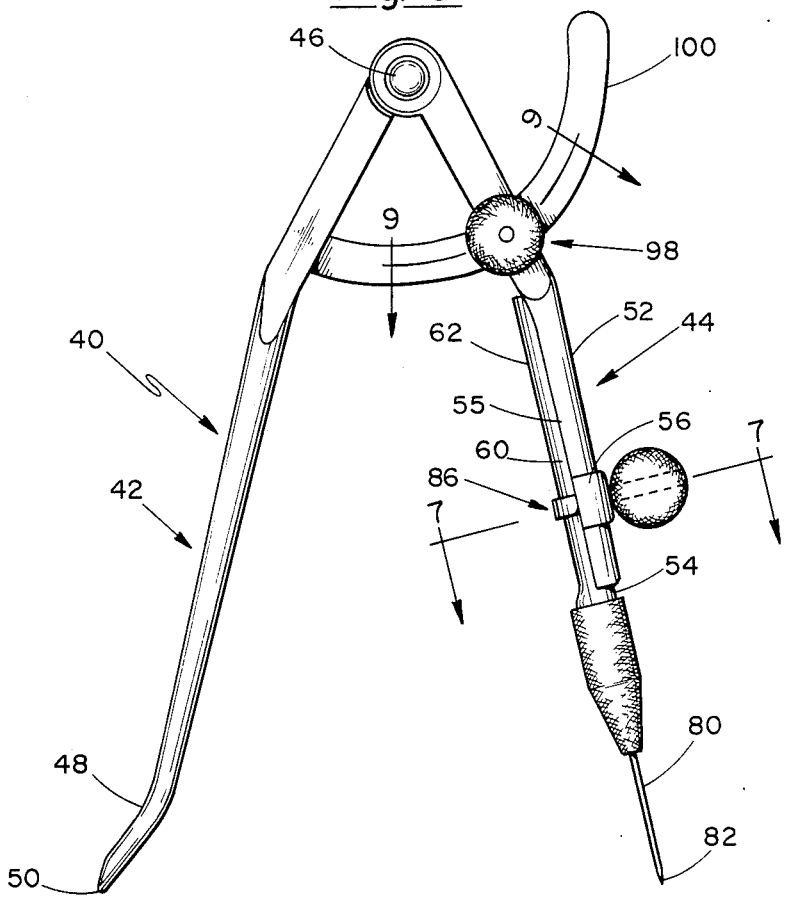
FIG. 5 is an elevational view of my cutting device, the device being on a larger scale than that shown in FIG. 1.
Figure 6:
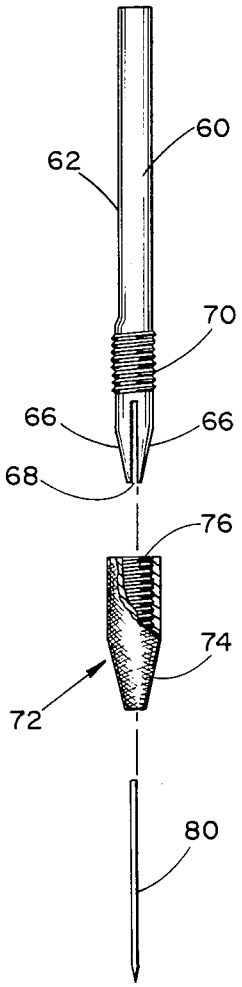
FIG. 6 is an exploded view of the components constituting the lower portion of one of the legs of my cutting device.

The cutting device or tool selected for the purpose of exemplifying my invention has been denoted generally by the reference numeral 40. Although the device 40 appears in FIG. 1, it is shown in greater detail in FIG. 5.

The cutting device 40 comprises a fixed length leg 42 and adjustable length leg 44, the two legs 42 and 44 being pivotally attached at their upper end by reason of a pin or rivet 46. The fixed length leg 42 has a lower end portion 48 that angles outwardly, terminating in a tip 50 that is intended to follow an irregular or nonlinear edge, such as that labeled 28.

Figure 7:
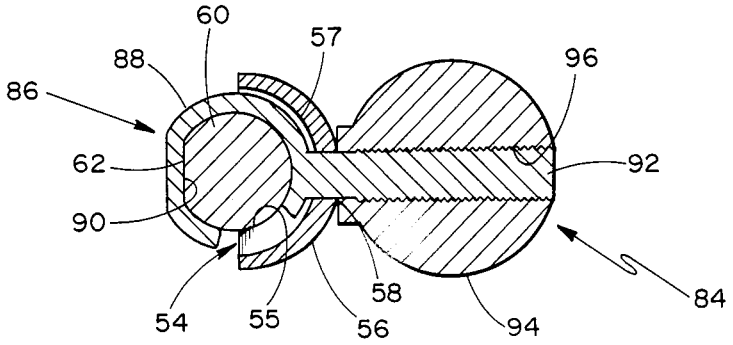
FIG. 7 is a sectional view taken in the direction of line 7—7 of FIG. 5 for the purpose of illustrating how the lower component of one of the legs of my device is clamped in an adjusted position with respect to the other component of the leg, a segmental portion of the ring head of a stirrup-shaped bolt having been broken away for clarity reasons.
Figure 8:
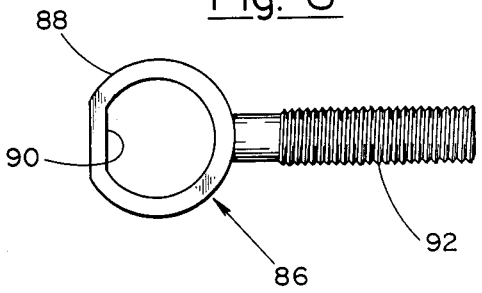
FIG. 8 is a plan view of a stirrup-like bolt utilized in the clamping action of FIG. 7.

The leg 44 is composed of an upper component 52 and a lower component 54; the lower component 54 being extensible relative to the upper component 52. The upper component 52 has a semicircular groove 55 formed longitudinally therein. However, there is an enlarged band at 56 forming a semi-annular inner cavity 57 (see FIG. 7). The band 56 has a hole at 58 for a purpose soon to be made manifest.

The lower or extensible component 54 is provided with a generally cylindrical shank 60, although the shank 60 has a flat portion 62. The lower component 54 has a pair of tapered jaws 66 formed by a slot 68. Just above the tapered jaws 66 is a threaded section 70. Although more will be said hereinafter concerning the slot 68, it can be pointed out at this stage that there is a collet or tubular sleeve 72 having an internally tapered lower portion 74 and an internally threaded upper portion 76. All that need be appreciated at this point is that when the collet 72 is advanced upwardly by means of its threaded portion 76, being engaged with the threaded portion 78, the tapered portion 74 thereof forces the tapered jaws 66 toward each other so as to grip a blade member 80 having a sloping knife edge 81 which provides a cutting point 82.

At this time attention is directed to a clamping mechanism indicated generally by the reference numeral 84. The clamping mechanism 84 functions to hold the lower component 54 in a preferred or extended relationship with the upper component 52. The clamping mechanism 84 comprises a stirrup-shaped bolt 86. The stirrup-shaped bolt 86 includes a ring-like head 88 having a flat at 90 which is engageable with the flat portion 62 of the lower component 54. A segmental portion of the ring-like head 88 has been broken away from between the 4:00 o'clock position to the 7:00 o'clock position in order to illustrate how the cylindrical shank is pulled tightly against the base of the semicircular groove 55. The bolt 86 has a threaded shank 92 that projects through the hole 58 provided in the upper component 52. A knurled ball-type nut 94 has an internally threaded or tapped bore 96. In this way, when the nut 94 is tightened, the flat 90 is pulled against the flat 62 so as to not only clamp the lower component 54 in a desired extended relationship with the upper component 52, but the two flats 62 and 90 prevent any rotation of the lower component 64 relative to the upper component 52, thereby maintaining the blade member 80 in a parallel relation with these flats 62, 90. The need for this will become apparent later on.

Figure 9:
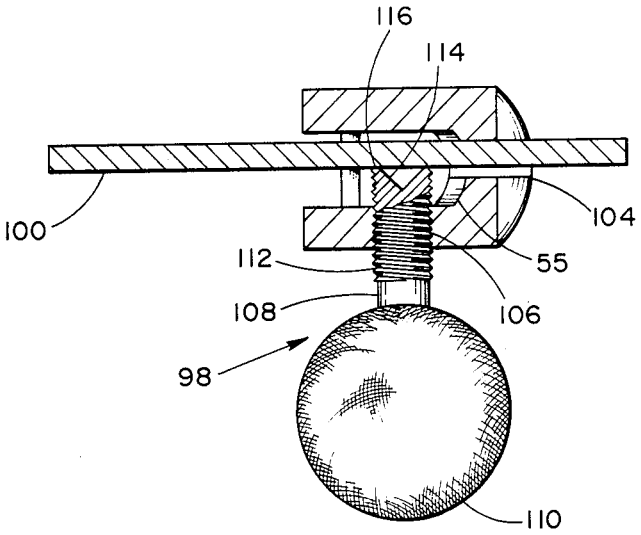
FIG. 9 is a sectional detail taken in the direction of line 9—9 of FIG. 5 for the purpose of showing how the two legs of my device are clamped in an angular relationship.

Whereas the clamping mechanism 84 maintains the components 52 and 54 in a longitudinally adjusted relationship with each other, an additional clamping mechanism 98 maintains the two legs 42 and 44 in an angularly adjusted relationship. The clamping mechanism 98 comprises an arcuate arm or strip 100 having one end fixedly attached to the leg 42, such as by welding or a rivet (not shown). The upper component 52 of the leg 44 has a slot 104 formed therein through which the arm or strip 100 extends, as can best be understood from FIG. 9. Owing to the presence of the semicircular groove 55 formed in the upper component 52, the upper component 52 has a channel-like cross section, as is readily discernible in FIG. 9. Also, the upper component 52 has a threaded hole 106 for the accommodation of a bolt or set screw 108, the set screw 108 having a knurled ball head 110, a threaded shank 112 formed with a cone-shaped recess 114 which provides a circular edge at 116. The circular edge 116 engages one side of the arcuate arm 100 so as to retain the two legs 42 and 44 in an angularly adjusted relationship.

When practicing my invention, as can be understood from FIG. 1, the tip 50 belonging to the angled lower end portion 48 of the fixed length leg 42 is placed against the irregular or nonlinear edge 28. This could be somewhat more to the left than actually shown in FIG. 1. More specifically, it would be at the faucet end of the fragmentarily depicted bathtub 24.

In FIG. 1, the worker's hand has been given the reference numeral 118 and all that the worker need do is to advance the device 40 so that the tip 50 traverses or follows the edge 28. By advancing the device 40 along the bathtub, more specifically by having the tip 50 follow the edge 28, the blade member 80 traverses a path having the same profile as the edge 28. In this regard, during the early movement of the device 40, the tip 50 is following a straight portion of the line 28 but when the tip 50 reaches the seat portion 26 of the bathtub 24, the device 40 is automatically shifted in an offset or jogged direction so that the resulting cut 120 appearing in solid outline in FIG. 1 is formed. It is believed helpful to label the uncut path yet to be traveled by the blade member 80, this uncut path having been given the reference numeral 122. It will be appreciated that the knife edge 81 which slopes rearwardly as far as the direction of movement of the tool 40 causes the lower cutting point 82 to actually sever a strip 124 from the vinyl sheet 30. The blade member 80 is maintained in a parallel relation with the flats 62 and 90 during this cutting step. The flats 62, 90 preventing any twisting of the blade member 80 while being held by the device 40.

Although the worker's hand 118 does not appear in FIG. 2, nonetheless the strip 124 is being removed, such as by his hand, after the cut 120 has been completed. This would be when the device or tool 40 reaches the wall 14. The remaining sheet has been labeled **30*a***.

Figure 4:
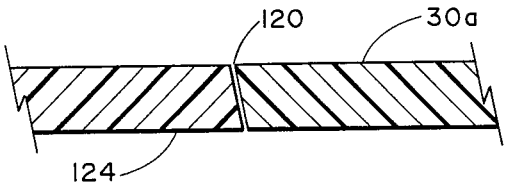
FIG. 4 is an enlarged sectional detail taken in the direction of line 4—4 of FIG. 1 for the purpose of showing the resulting beveled cut when practicing my invention.

Inasmuch as the two legs 42 and 44 of the device 40 are held in an angularly adjusted relationship through the agency of the clamping mechanism 98, a beveled cut 120 is produced. The slope of this cut 120 is shown in FIG. 4. This forms an acute angle at the upper surface of the remaining portion of the vinyl sheet 60. Although my invention, generally speaking, avoids the need for any additional trimming, nonetheless, the acute angle labeled 126 in FIG. 4 permits a lesser amount of the vinyl sheet 30 to be removed if a closer or refined fit with the line 28 is required. It must be borne in mind that the irregular or nonlinear edge 28 is of a simplified character, for in actual practice far more intricate and complex edges 28 can be encountered. Whatever the complexity or degree of irregularity is, though, my invention provides an accurate tracing of such edge so that the resulting edge on the vinyl is replicated, corresponding closely to the edge with which the vinyl is to be mated.

After the strip 124 has been removed, then the worker shifts or slides the entire remaining vinyl sheet **30*a* towards the bathtub 24 so as to cause the cut edge 120 to abut the bathtub 24 along the line 28, all as pictured in FIG. 3**.

The bathtub 24 might very well not extend along the complete length of the wall 12. For instance, there could be a door in the wall 12. Whatever the irregularity of the edge 28, my invention permits the following of such edge to form at least one cut or profiled edge for the vinyl sheet **30*a*. In practice, the worker would select the most intricate edge of a room or a wall, then traversing that edge in the same fashion that has just been described with respect to the edge 28. By selecting the more complex edge configuration of a room, the need for providing a pattern for the other or remaining edges of room is minimized. If the other edges are truly straight and at right angles with respect to each other, no pattern whatsoever is needed. If one of the other edges does have an irregular contour, then a conventional pattern, such as felt paper, can be resorted to. Whenever a pattern is used, all that the worker need do is follow the scribed line on the pattern, using my cutting device 40 to sever a marginal strip from portion of the sheet that projects from beneath the pattern. Stated more specifically, the worker covers the tip 50 to follow along the scribed mark on the pattern, the cutting point 82 of the blade member 80** then cutting the vinyl sheet along a line corresponding to the scribed line or mark on the pattern. In any event, the number of times a pattern is needed is substantially reduced when utilizing the teachings of my invention and when a pattern is used the profiling step is vastly simplified.

It is important to appreciate that while the laying of vinyl has been herein described, my invention is susceptible to use with other flexible or resilient coverings. In this regard, carpeting has such a flexible and compressible surface that it does not lend itself readily to any scribing technique. Similarly, some wall coverings, such as vinyl-covered panels are not capable of being marked with a scriber. A vinyl sheet has been particularly troublesome, for the resiliency of such material causes the scribed mark, when attempted, to almost immediately disappear. Stated somewhat differently, the plastic material simply flows back, closing up the indented or embossed mark when made by a scriber. My invention eliminates the need for even attempting to scribe one edge, for that edge can be severed without scribing.

I claim:

1. A method of profiling sheet material for installation in a room having a nonlinear edge formed by the juncture of horizontal and vertical surfaces, the method comprising the steps of advancing one leg of a device along a nonlinear path corresponding to the nonlinear edge with which said sheet material is to be fitted, said device having a second leg provided with a blade member formed with a knife edge so that said blade member cuts along a second nonlinear path determined by the direction in which said first leg is advanced along said nonlinear path to provide a severed strip of said material possessing a nonlinear cut edge corresponding to said nonlinear path and also providing a nonlinear edge on the remaining material corresponding to said nonlinear path, removing said severed strip, and then abutting the nonlinear cut edge of said remaining sheet material against said nonlinear edge that is to be fitted.

2. The method of claim 1 in which said sheet material is resilent vinyl.

3. A method of profiling sheet material for installation in a room having a nonlinear edge formed by the juncture of horizontal and vertical surfaces, the method comprising the steps of placing one edge of the sheet material adjacent the nonlinear edge with which the material is to be fitted, advancing the free end of one leg of a device along the nonlinear edge with which said sheet material is to be fitted while maintaining said free end in physical contact with both the horizontal surface and the vertical surface forming said nonlinear edge, said device having a second leg provided with a blade member formed with a knife edgd so that said blade member cuts along a nonlinear path or line determined by the direction in which said first leg is advanced along said nonlinear edge to provide a severed strip of said material possessing a nonlinear edge and also providing a nonlinear cut edge on the remaining material corresponding to said nonlinear path, removing said severed strip, and then abutting the nonlinear cut edge of the ramaining sheet material against said nonlinear edge that is to be fitted.

4. The method of claim 3 in which said legs are pivotally connected together, and including the step of angularly adjusting said legs so that said strip is sufficiently narrow to avoid undue waste of said sheet material.

5. The method of claim 3 in which said second leg is longitudinally adjustable.

6. The method of claim 5 in which the angular adjustment of said first leg and the longitudinal adjustment of said second leg provides a beveled cut by said blade member.

7. A device for cutting sheet material comprising first and second angularly adjustable leg means, said first leg means having an end adapted to follow a first line corresponding to an edge with which said sheet material is to be fitted, said second leg means including a first component pivotally connected to said leg having a longitudinal groove formed therein and a second component longitudinally adjustable with respect to said first component having a generally cylindrical shank formed with a flat on one side thereof and means encircling said shank, said encircling means having a flat for preventing the turning or twisting of said second component relative to said first component, said encircling means including a stirrup-like bolt and said bolt including a ring-type head with the flat on said encircling means being on the inside of said ring-like head, said blade means extending parallel to said flats, and means for clamping said first and second leg means in a preferred angularly adjusted relation.

8. The device of claim 7 in which said bolt has a threaded stud extending through a hole in said first component, and a nut threadedly mounted on said stud so that the flat of said ring-type head is pulled against the flat on said generally cylindrical shank.

9. A device for cutting sheet material comprising first and second leg means, a pin pivotally connecting said first and second leg means together at one end of said first and second leg means, said first leg means having an outwardly angled end portion forming a tip at the end opposite said one end thereof which tip is adapted to follow a first line corresponding to an edge with which said sheet material is to be fitted, means spaced from said pin for clamping said first and second leg means in a preferred angularly adjusted relation, and blade means of said second leg means for cutting said sheet material along a second line determined by the end of first leg means as it follows said first line.

10. The device of claim 9 in which said second leg means includes a first component pivotally connected to said first leg and a second component longitudinally adjustable with respect to said first component.

11. The device of claim 10 including a pair of jaw members at one end of said second component, and means for forcing said jaw members against said blade means.

12. The device of claim 11 in which said jaw members are tapered, and a sleeve member threadedly carried on said second component adjacent said jaw members, said sleeve member having a tapered portion for acting on said tapered jaw members to cause said jaw members to be forced against said blade means.

13. The device of claim 10 in which said first component has a longitudinal groove formed therein and said second component has a generally cylindrical shank formed with a flat on one side thereof and means encircling said shank, said encircling means having a flat for preventing the turning or twisting of said second component relative to said first component.

14. The device of claim 13 in which said blade means extends parallel to said flats.

* * * * *